US009765797B2

(12) United States Patent
Briggs et al.

(10) Patent No.: US 9,765,797 B2
(45) Date of Patent: Sep. 19, 2017

(54) JET-VENTURI BACK FLOW PREVENTION STRUCTURE FOR A FUEL DELIVERY MODULE

(75) Inventors: Paul F. Briggs, Brand Blanc, MI (US); Jeffery J. Milton, Lake Orion, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 2315 days.

(21) Appl. No.: 11/438,420

(22) Filed: May 23, 2006

(65) Prior Publication Data

US 2006/0275144 A1 Dec. 7, 2006

Related U.S. Application Data

(60) Provisional application No. 60/686,877, filed on Jun. 2, 2005.

(51) Int. Cl.
*F04F 5/44* (2006.01)
*F04F 5/46* (2006.01)
*F02M 37/02* (2006.01)

(52) U.S. Cl.
CPC ..... *F04F 5/44* (2013.01); *F04F 5/46* (2013.01); *F02M 37/025* (2013.01)

(58) Field of Classification Search
CPC ..... F02M 37/025; F04F 5/02; F02K 1/386; F02K 1/48; F02K 1/30
USPC ..... 417/198, 151, 53, 87, 159, 168, 194; 123/514, 41.45, 509, 495, 497; 137/565.22, 890; 239/594, 601, 265.19
See application file for complete search history.

(56) References Cited

U.S. PATENT DOCUMENTS 1,437,819 A * 12/1922 Schmidt ..... F01B 25/00 417/163
1,936,246 A * 11/1933 Carter et al. ..... 417/198
2,164,263 A * 6/1939 Wall ..... 417/179
2,332,982 A * 10/1943 Blair ..... B01D 35/043 210/410
3,785,560 A * 1/1974 Hruby, Jr. ..... B05B 17/08 239/17
4,419,074 A * 12/1983 Schuetz ..... 431/354
4,834,132 A * 5/1989 Sasaki ..... B60K 15/01 123/514

(Continued)

FOREIGN PATENT DOCUMENTS

DE 19805072 A1 * 8/1999
GB 699316 A * 11/1953 ..... B64F 1/28

OTHER PUBLICATIONS

English langauge machine translation of DE19805072 to Frank et al.;published Sep. 2, 1998;GmbH.*

*Primary Examiner* — Nathan Zollinger
*Assistant Examiner* — Amene Bayou

(57) ABSTRACT

A jet and venturi tube arrangement is provided for a fuel delivery module. The arrangement includes a venturi tube 14 having an opening 15, an internal wall 24 and a central axis C. A jet 10' is provided that has an exit 22. The jet 10' is constructed and arranged to spray a stream 12 of fuel from the exit 22 into the opening 15 of the venturi tube 14 substantially along the central axis C. The jet 10' has surface features 20, near the exit, constructed and arranged to divert a portion 12' of the stream 12 of fuel so that the portion 12' contacts the internal wall 24 of the venturi tube 14 thereby limiting back flow of fuel through the opening of the venturi tube.

8 Claims, 1 Drawing Sheet

(56) References Cited

U.S. PATENT DOCUMENTS

| | | | | |
|---|---|---|---|---|
| 5,082,426 | A * | 1/1992 | Sasaki et al. | 417/198 |
| 5,564,397 | A * | 10/1996 | Kleppner et al. | 123/514 |
| 5,664,733 | A * | 9/1997 | Lott | B01F 5/02 239/429 |
| 6,269,800 | B1 * | 8/2001 | Fischerkeller et al. | 123/514 |
| 6,296,454 | B1 * | 10/2001 | Schmid et al. | 417/151 |
| 6,619,272 | B2 * | 9/2003 | Jones et al. | 123/514 |
| 6,877,960 | B1 * | 4/2005 | Presz et al. | 417/198 |
| 6,951,208 | B2 * | 10/2005 | Milton | 123/509 |
| 2002/0081211 | A1 * | 6/2002 | Benghezal et al. | 417/87 |

* cited by examiner

JET-VENTURI BACK FLOW PREVENTION STRUCTURE FOR A FUEL DELIVERY MODULE

This application claims the benefit of the earlier filing date of U.S. Provisional Application No. 60/686,877, filed on Jun. 2, 2005, which is incorporated by reference herein in its entirety.

FIELD OF THE INVENTION

The invention relates to automotive fuel delivery modules and, more particularly, to a jet and venturi tube arrangement that creates a vacuum for drawing fuel into a reservoir of a fuel delivery module.

BACKGROUND OF THE INVENTION

A fuel delivery module is a device inside a fuel tank that allows a vehicle to perform under conditions when low fuel remains in the fuel tank. A typical module includes a reservoir that is kept continuously full by jet and venturi tube arrangement, even when the remainder of the fuel tank is nearly empty. With reference to FIG. 1, a typical jet 10 is shown that sprays fuel 12 into an associated venturi tube 14. The conventional molded jet 10 is of too good quality, since the stream of fuel 12 leaving the jet is almost perfect, in that it is substantially straight along central axis C of the venturi tube 14. In theory, the straight spraying of fuel by the jet 10 is best for the jet/venturi tube function for creating a vacuum near an inlet valve 16 so that the valve 16 can raise permitting fuel from a fuel tank to pass an opening 17 in the reservoir 18 and thus enter the reservoir 18.

In practice, when the jet 10 is operating with no fuel for the vacuum to pull in, and with the reservoir 18 full of fuel, the fuel in the reservoir is allowed to flow back through the venturi tube 14 and towards the inlet valve 16. This back flow of fuel can result in leakage of fuel past the inlet valve and out of the reservoir via opening 17.

Thus, there is a need to prevent or limit back flow of fuel through the venturi tube.

SUMMARY OF THE INVENTION

An object of the invention is to fulfill the need referred to above. In accordance with the principles of the present invention, this objective is achieved by a jet and venturi tube arrangement for a fuel delivery module. The arrangement includes a venturi tube having an opening, internal wall, and a central axis. A jet is provided having an exit. The jet is constructed and arranged to spray a stream of fuel from the exit into the opening of the venturi tube substantially along the central axis. The jet has surface features, associated with the exit, constructed and arranged to divert a portion of the stream of fuel so that the portion contacts the internal wall of the venturi tube thereby limiting back flow of fuel through the opening of the venturi tube.

In accordance with another aspect of the invention, a method of limiting back flow through a venturi tube of a fuel delivery module is provided. A reservoir is provided having an opening and a valve associated with the opening. The valve is movable to control passing of fuel through the opening to fill the reservoir. A venturi tube is provided in the reservoir and has an opening, internal wall, and a central axis. A jet is provided in the reservoir and is associated with the venturi tube. The jet has an exit and is constructed and arranged to spray a stream of fuel from the exit into the opening of the venturi tube substantially along the central axis thereby creating a vacuum to move the valve to permit fuel to enter the reservoir through the opening. The method ensures that the jet diverts a portion of the stream of fuel so that the portion contacts the internal wall of the venturi tube thereby limiting back flow of fuel through the opening of the venturi tube.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
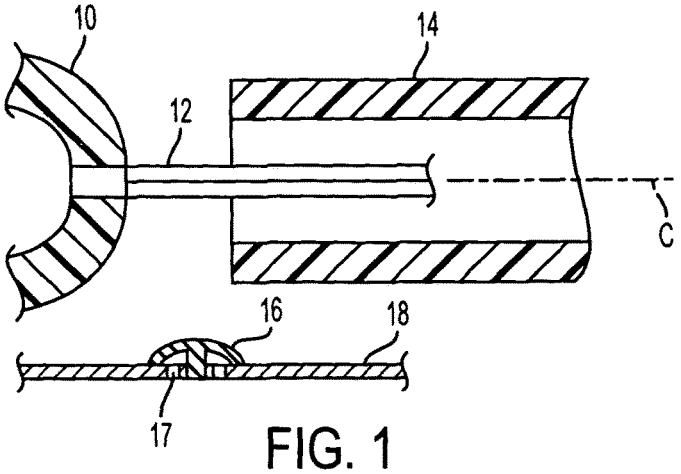
FIG. 1 PRIOR ART
FIG. 1 is a sectional view of a conventional jet and venturi tube arrangement for drawing fuel past an inlet valve and into a reservoir of a fuel delivery module.
Figure 2:
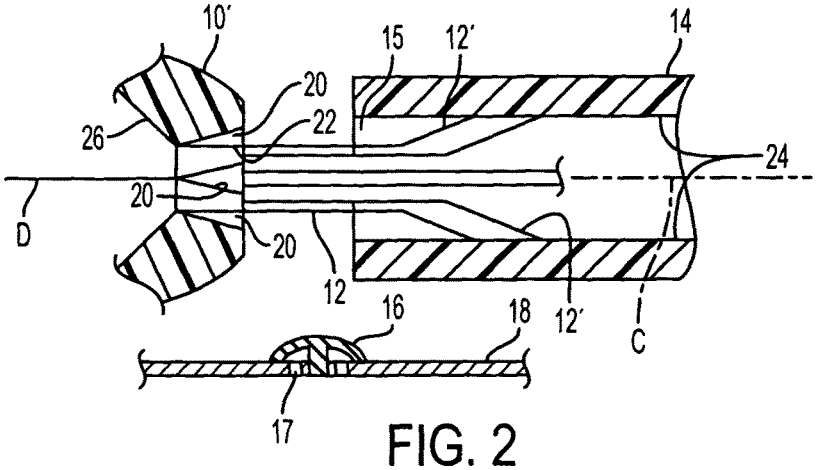
FIG. 2 is a sectional view of a jet and venturi tube, with the jet having surface features that permit fuel to be sprayed against an internal wall of the venturi tube in accordance with the principles of the present invention.

With reference to FIG. 2, a sectional view of a jet 10' and venturi tube 14 is shown in accordance with the principles of the invention, disposed in a conventional fuel reservoir 18. Note that only a bottom portion of the reservoir 18 is shown in FIG. 2. The venturi tube 14 is also conventional and has an opening 15, an internal wall 24, and a central axis C. Surface features 20, associated with a jet exit 22, are provided in the jet 10' to peel away a part of a jet stream 12 from the central axis C so as to flow against the internal wall 24 of the venturi tube 14 and act as a barrier to help prevent or limit back flow of fuel from the venturi tube 14.

Figure 3:
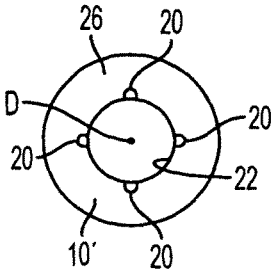
FIG. 3 is an end view of the jet showing surface features of FIG. 2.

As best shown in FIG. 3, the surface features 20 are preferably molded into or formed into the diameter of the jet exit 22. The surface features 20 cause a small amount of fuel 12' to be diverted from away from travel generally along axis D of the jet exit 22 and axis C of the venturi tube 14 and directed towards the venturi tube 14 internal wall 24. The diverted fuel 12' is particularly useful when the jet 10' is operating without creating a vacuum (created by the jet and venturi tube) to pull in fuel, and with the reservoir 18 full of fuel. Under such conditions, the diverted fuel 12' prevents or limits backflow of fuel from the venturi tube 14 into the area of valve 16.

In the embodiment, the jet exit 22 is annular and four, evenly spaced (e.g., 90 degrees apart) surface features 20 are provided preferably as channels in a body 26 of the jet 10' that taper outwardly toward the internal wall 24 to guide the diverted fuel 12' to the internal wall 24. The channels 20 are in communication with the jet exit 22. It can be appreciated that more or less than four surface features 20 can be provided, evenly or unevenly spaced. The surface features 20 can be of any configuration that diverts a portion of the jet stream 12.

Thus, spraying of fuel by the jet 10' creates a vacuum near the inlet valve 16 so that the inlet valve 16 can raise permitting fuel from a fuel tank to pass the opening 17 in the reservoir 18 and thus enter the reservoir 18. The jet stream 12' diverted to the internal wall 24 acts as a barrier to help prevent or limit back flow of fuel into the venturi tube 14, past the inlet valve 16 and out of the reservoir 18 via the opening 17.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A jet and venturi tube arrangement for a fuel delivery module, the arrangement comprising:

a venturi tube having an opening, internal wall, and a central axis, and a jet having a non-tapered exit opening disposed on the central axis, the jet being constructed and arranged to spray a stream of fuel from the exit opening into the opening of the venturi tube substantially along the central axis, the jet having surface features associated with the exit and constructed and arranged to divert a portion of the stream of fuel so that the portion contacts the internal wall of the venturi tube thereby limiting back flow of fuel through the opening of the venturi tube, wherein the surface features include a plurality of channels in a body of the jet, and wherein each channel is provided about a periphery of the exit opening and communicating therewith, each channel tapers outwardly toward the internal wall of the venturi tube so as to be at an acute angle with respect to the central axis so as to guide the portion of fuel to the internal wall, the channels being constructed and arranged in the body so that a solid, continuous arc-shaped wall is defined in the body between surfaces that define adjacent channels so that fuel can flow only through the channels and the exit opening.

2. The arrangement of claim 1, wherein the exit opening is annular and four surface features are provided.

3. The arrangement of claim 2, wherein the four surface features are evenly spaced about the periphery of the annular exit opening.

4. A method of limiting back flow through a venturi tube of a fuel delivery module, the method including:

providing a reservoir having an opening and a valve associated with the opening, the valve being movable to control passing of fuel through the opening to fill the reservoir, providing a venturi tube in the reservoir, the venturi tube having an opening, internal wall, and a central axis, providing a jet in the reservoir associated with the venturi tube, the jet having a non-tapered exit opening disposed on the central axis, the jet being constructed and arranged to spray a stream of fuel from the exit opening into the opening of the venturi tube substantially along the central axis thereby creating a vacuum to move the valve to permit fuel to enter the reservoir through the opening, and ensuring that the jet diverts a portion of the stream of fuel so that the portion contacts the internal wall of the venturi tube thereby limiting back flow of fuel through the opening of the venturi tube, wherein the ensuring step includes the provision of surface features in a body of the jet, the surface features including channels provided about a periphery of the exit opening and communicating therewith, each channel tapering outwardly toward the internal wall of the venturi tube so as to be at an acute angle with respect to the central axis to divert the portion of fuel, the channels being constructed and arranged in the body so that a solid, continuous arc-shaped wall is defined in the body between surfaces that define adjacent channels so that fuel can flow only through the channels and the exit opening.

5. The method of claim 4, wherein the exit opening is annular and four channels are provided.

6. The method of claim 5, wherein the four channels are evenly spaced about the periphery of the annular exit opening.

7. A jet for a fuel delivery module, the jet comprising:

a hollow body having an interior, the body defining a non-tapered exit opening in direct communication with the interior and disposed on and extending along a central axis of the body, the exit opening extending through a distal end face of the body, the jet being constructed and arranged to spray a stream of fuel from the exit opening substantially along the central axis, the body having surface features associated with the exit opening, the surface features being constructed and arranged to divert a portion of the stream of fuel away from the central axis, wherein the surface features include a plurality of channels provided about a periphery of the exit opening and communicating therewith at the distal end face of the body, and wherein each channel tapers outwardly and away from the central axis so as to be at an acute angle with respect to the central axis to guide fuel away from the central axis, the channels being constructed and arranged in the body so that a solid, continuous arc-shaped wall is defined in the body between surfaces that define adjacent channels so that fuel can flow only through the channels and the exit opening.

8. The jet of claim 7, wherein the exit opening is annular and four, evenly spaced, surface features are provided about the periphery of the exit opening.

* * * * *